US008581811B2

(12) United States Patent
Lee et al.

(10) Patent No.: US 8,581,811 B2
(45) Date of Patent: Nov. 12, 2013

(54) ORGANIC LIGHT EMITTING DISPLAY DEVICE AND DRIVING METHOD THEREOF

(75) Inventors: Wang-Jo Lee, Suwon-si (KR); Sang-Moo Choi, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 921 days.

(21) Appl. No.: 12/249,731

(22) Filed: Oct. 10, 2008

(65) Prior Publication Data

US 2009/0207110 A1 Aug. 20, 2009

(30) Foreign Application Priority Data

Feb. 20, 2008 (KR) ..... 10-2008-0015399

(51) Int. Cl.
*G09G 3/32* (2006.01)

(52) U.S. Cl.
USPC ..... 345/82; 345/76; 327/94

(58) Field of Classification Search
USPC ..... 345/82; 327/94
See application file for complete search history.

(56) References Cited

U.S. PATENT DOCUMENTS

| | | | | |
|---|---|---|---|---|
| 5,376,841 | A * | 12/1994 | Itakura et al. | 327/94 |
| 7,262,751 | B2 * | 8/2007 | Chung et al. | 345/76 |
| 7,528,810 | B2 * | 5/2009 | Ohshima et al. | 345/77 |
| 7,724,230 | B2 * | 5/2010 | Kim et al. | 345/98 |
| 7,738,512 | B2 * | 6/2010 | Shin | 370/536 |
| 7,804,468 | B2 * | 9/2010 | Park et al. | 345/77 |
| 2005/0117611 | A1 * | 6/2005 | Shin | 370/536 |
| 2005/0264495 | A1 * | 12/2005 | Shin | 345/76 |
| 2006/0139258 | A1 * | 6/2006 | Choi et al. | 345/76 |
| 2006/0139266 | A1 * | 6/2006 | Choi | 345/77 |
| 2007/0024544 | A1 * | 2/2007 | Chung et al. | 345/76 |
| 2007/0234152 | A1 * | 10/2007 | Kwon et al. | 714/726 |

FOREIGN PATENT DOCUMENTS

| | | |
|---|---|---|
| KR | 10-2004-0060708 | 7/2004 |
| KR | 10-2005-0045129 | 5/2005 |
| KR | 10-2005-0114827 | 12/2005 |
| KR | 10-2007-0024125 | 3/2007 |
| KR | 10-2007-0024126 | 3/2007 |
| KR | 10-2008-0014331 | 2/2008 |

OTHER PUBLICATIONS

Office action dated Mar. 25, 2008 for corresponding Korean Patent Application No. 10-2008-0015399 listing the cited reference.

Korean Office action dated May 28, 2009, for priority Korean application 10-2008-0015399, noting listed references in this IDS, as well as KR 10-2007-0024126, previously filed in an IDS dated Apr. 23, 2009.

* cited by examiner

*Primary Examiner* — William Boddie
*Assistant Examiner* — Sahlu Okebato
(74) *Attorney, Agent, or Firm* — Christie, Parker & Hale, LLP

(57) ABSTRACT

The organic light emitting display device according to the present invention includes a scan driver for supplying a scan signal to scan lines during a frame time-divided into a plurality of subframes, a data driver coupled to output lines for supplying data signals on each of the output lines, data distributors coupled to the output lines for distributing the data signals to data lines, concurrently, in synchronization with the scan signal, and pixels located at crossing regions of the data lines and the scan lines. Each of the data distributors includes a sampling latch for distributing the data signals to different channels and for storing the data signals, and a holding latch coupled to the sampling latch for supplying the data signals of the channels to the data lines concurrently.

9 Claims, 3 Drawing Sheets

ORGANIC LIGHT EMITTING DISPLAY DEVICE AND DRIVING METHOD THEREOF

CROSS-REFERENCE TO RELATED APPLICATION

This application claims priority to and the benefit of Korean Patent Application No. 10-2008-0015399, filed on Feb. 20, 2008, in the Korean Intellectual Property Office, the entire content of which is incorporated herein by reference.

BACKGROUND OF THE INVENTION

1. Field of the Invention

The present invention relates to an organic light emitting display device and a driving method thereof.

2. Description of Related Art

In recent years, flat panel display devices having reduced weight and volume in comparison to a cathode ray tube (CRT) have been developed. The flat panel display devices include a liquid crystal display (LCD), a field emission display (FED), a plasma display panel (PDP), an organic light emitting display, etc.

Among the flat panel displays, the organic light emitting display displays an image using organic light emitting diodes (OLEDs) that emit light through the recombination of electrons and holes. The organic light emitting display has advantages such as rapid response time and low power consumption.

Pixels in conventional organic light emitting display devices utilizing an analog drive system display an image by charging a storage capacitor (Cst) in each of the pixels with a predetermined voltage and supplying an electrical current, which corresponds to the charged voltage, to the OLEDs. The analog drive system may have difficulty uniformly displaying an image due to variations in the threshold voltage and mobility of the drive transistors between the pixels.

Organic light emitting displays utilizing a digital drive system rather than an analog drive system may more uniformly display an image. The digital drive system supplies data signals to each of the pixels, wherein the data signals correspond to turn-on and turn-off states, and displays gray levels by controlling the time that the pixels are turned on during a frame that is time-divided into a plurality of subframes. The digital drive system may display an image uniformly regardless of the variations of the drive transistors between the pixels.

Digital drive systems may have difficulty supplying a correct data signal to each of the pixels utilizing a demultiplexer since the digital drive system is driven with one frame being time-divided into a plurality of subframes. In conventional digital drive systems, the demultiplexer has been used to reduce the number of channels in the data drivers. The demultiplexer transfers a data signal to a plurality of data lines, wherein the data signal is supplied to an output end of each of the data drivers.

In a conventional digital drive system, wherein the number of the subframes in one frame is 15 and a first horizontal period is set to approximately 1.39 μs in driving a 3-inch WVGA panel (800×480 RGB), the demultiplexer (for example, a 1:2 demultiplexer) transfers a data signal, which is supplied to one output line, to two data lines during one 1.39 μs horizontal period.

Each of the pixels is supplied with a data signal during ½ of the horizontal period when the data signal is transmitted to two data lines using a demultiplexer. Accordingly, the data signal may not be supplied to the pixels for a sufficient amount of time. In particular, the use of the demultiplexer requires some additional time in the horizontal period to ensure a drive margin of a switch that is included in each of the channels.

SUMMARY OF THE INVENTION

In exemplary embodiments of the present invention, there is provided an organic light emitting display device and a driving method thereof. The Organic light emitting display device may help reduce complexity, lowering the manufacturing cost of the Organic light emitting display device, while increasing the driving speed of the Organic light emitting display device.

In an exemplary embodiment of the present invention, there is provided an organic light emitting display device, wherein the organic light emitting display device includes a scan driver for supplying a scan signal to scan lines during a frame time-divided into a plurality of subframes, a data driver coupled to output lines for supplying data signals on each of the output lines, data distributors coupled to the output lines for distributing the data signals to data lines, concurrently, in synchronization with the scan signal, and pixels located at crossing regions of the data lines and the scan lines, wherein each of the data distributors comprises a sampling latch for distributing the data signals to different channels and for storing the data signals, and a holding latch coupled to the sampling latch for supplying the data signals of the channels to the data lines concurrently.

In another exemplary embodiment according to the present invention, there is disclosed a driving method of an organic light emitting display device, wherein the driving method includes supplying i data signals on each of output lines, storing the i data signals in i capacitors, and supplying the data signals stored in the i capacitors to i data lines concurrently, wherein i is an integer that is greater or equal to 2.

In another exemplary embodiment according to the present invention, there is disclosed a driving method of an organic light emitting display device, wherein the driving method includes providing data signals to data distributors through output lines, distributing the data signals into different channels, wherein each of the channels comprises a first switch coupled with one of the data distributors, a second switch coupled with the first switch, and a first capacitor coupled to a node between the first switch and the second switch, storing the data signals in the capacitors of the channels by turning on the first switch for each of the channels at different time periods, and turning on the second switch of each of the channels to supply the data signals stored in the capacitors to corresponding data lines concurrently.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
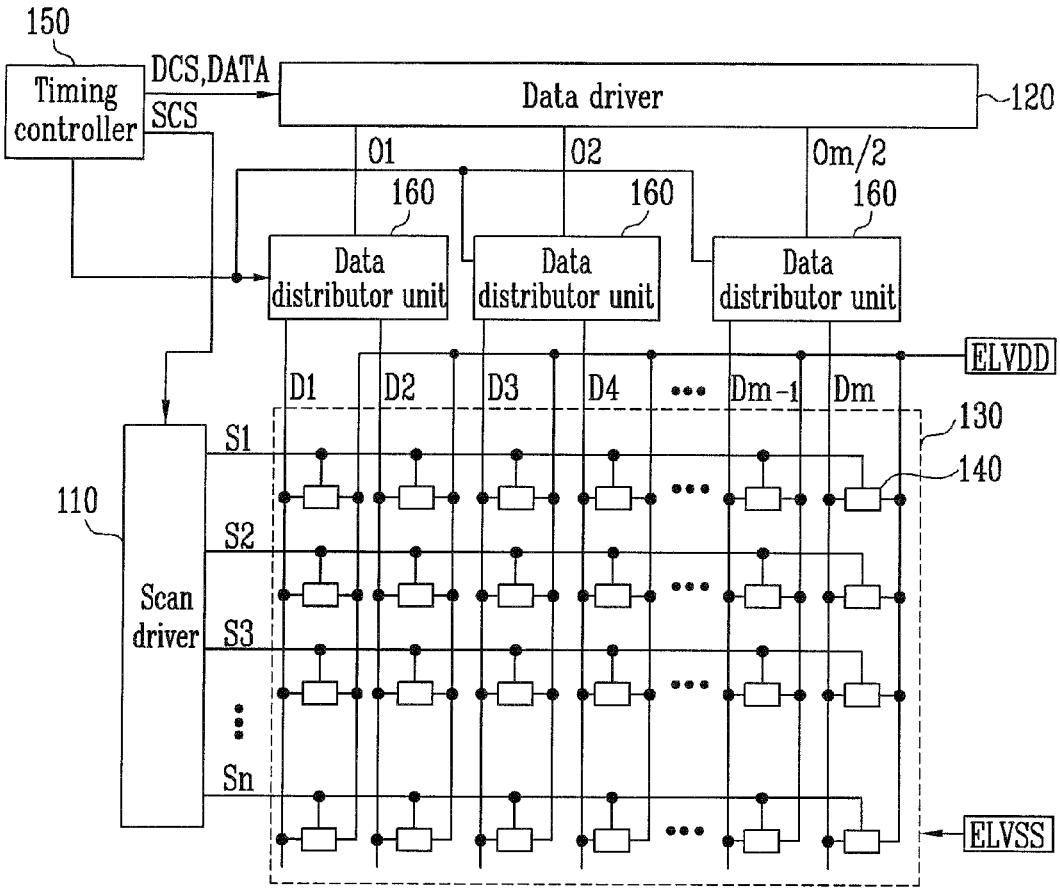
FIG. 1 is a diagram showing an organic light emitting display device according to an exemplary embodiment of the present invention.

Hereinafter, certain exemplary embodiments according to the present invention will be described with reference to the accompanying drawings. Here, when a first element is described as being coupled to a second element, the first element may be directly coupled to the second element or may be indirectly coupled to the second element via a third element. Further, some of the elements that are not essential to the complete understanding of the invention are omitted for clarity. Also, like reference numerals refer to like elements throughout.

FIG. 1 is a diagram showing an organic light emitting display device according to an exemplary embodiment of the present invention. In FIG. 1, each of data distributor units 160 is coupled to two data lines D for convenience of description, but the present invention is not limited thereto.

Referring to FIG. 1, the organic light emitting display device according to one exemplary embodiment of the present invention includes a scan driver 110, a data driver 120, a display unit 130, a timing controller 150, and a data distributor unit 160. FIG. 1 shows a single scan driver 110 coupled to multiple scan lines (S1 to Sn), a single data driver 120 coupled to multiple output lines (O1 to Om/2), and a single timing controller 150 for convenience of description, but the present invention is not limited thereto.

The timing controller 150 generates a data drive control signal DCS and a scan drive control signal SCS to correspond to synchronizing signals supplied from the outside. The data drive control signal generated in the timing controller 150 is supplied to the data driver 120, and the scan drive control signal is supplied to the scan driver 110. The timing controller 150 rearranges data DATA supplied from the outside, and supplies the rearranged data to the data driver 120. Also, the timing controller 150 controls the turn-on and turn-off of at least two switches (e.g., shown in FIG. 3) in the data distributor unit 160.

The data driver 120 sequentially supplies two data signals to each of output lines (O1 to Om/2) during every horizontal period of a plurality of subframes in one frame. The data signals include a first data signal for controlling the pixels 140 to emit light, and a second data signal for controlling the pixels 140 not to emit light.

The scan driver 110 supplies a scan signal to scan lines (S1 to Sn) during every horizontal period of each of the subframes. When the scan signal is supplied to the scan lines (S1 to Sn), the pixels 140 are selected line by line. The selected pixels 140 receive the first data signal or the second data signal from the data lines (D1 to Dm).

The display unit 130 receives a first power source ELVDD and a second power source ELVSS from the outside, and supplies the received first power source and second power source to each of the pixels 140. Each of the pixels 140 is supplied with a data signal when the scan signal is supplied to each of the pixels 140. Each of the pixels 140 emits light or does not emit light during each of the subframes according to the received data signals.

The data distributors 160 are coupled with all output lines (O1 to Om/2) of each of the data drivers 120. Each of the data distributors 160 is coupled two data lines D to supply a data signal, supplied to each of the output lines (O1 to Om/2), to the two data lines D. Here, the data distributors 160 concurrently supply a data signal to the two data lines D, which are coupled to the data distributors 160, in synchronization with the scan signals. While each data distributor 160 distributes data signals to two data lines in the described embodiment, the present invention is not Imiited thereto. In other embodiments, each data distributors 160 may supply data signals to three or more data lines.

FIG. 1 shows the data distributors 160 separate from the data driver 120, but the present invention is not limited thereto. For example, each of the data distributors 160 may be integrated with the data driver 120 on an integrated circuit.

Figure 2:
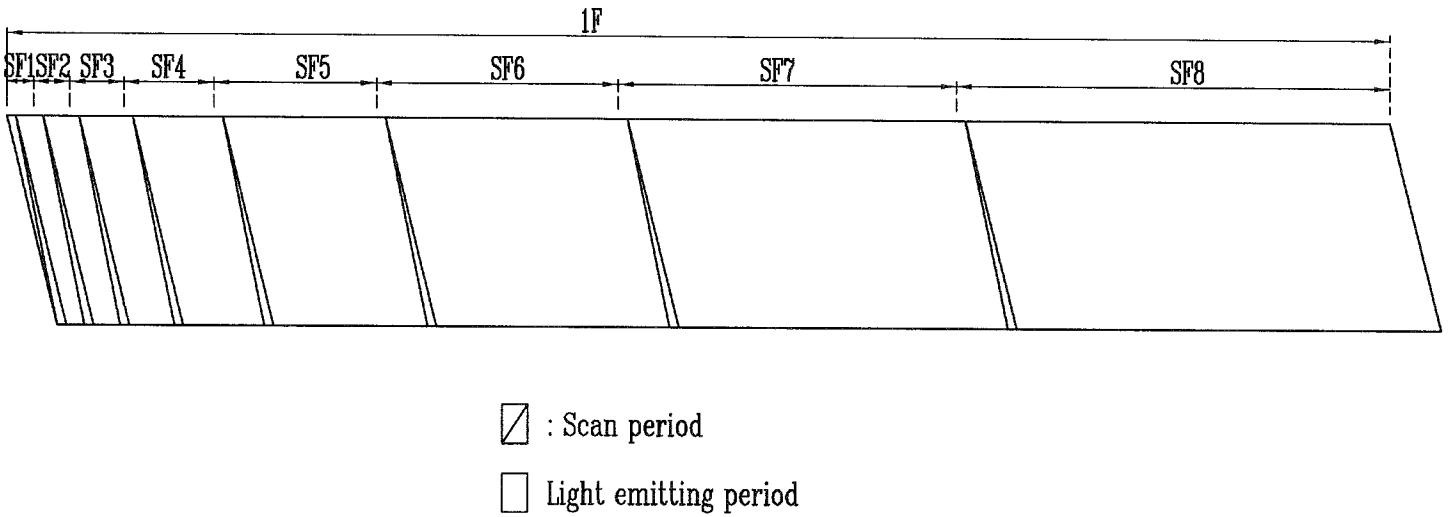
FIG. 2 is a diagram showing a frame according to an exemplary embodiment of the present invention.

FIG. 2 is a diagram showing a frame according to an exemplary embodiment of the present invention.

Referring to FIG. 2, the frame 1F according to an embodiment of the present invention is divided into a plurality of subframes (SF1 to SF8) for driving the organic light emitting display device (digital drive system). Each of the subframes (SF1 to SF8) is divided into a scan period for supplying a scan signal and a light emission period in which the pixels 140 emit light. The pixels 140 also receive a first data signal during the scan period to emit light.

The scan signal is supplied to the scan lines (S1 to Sn) during the scan period. Concurrently, the data signal, which is divided and supplied (i.e., distributed) to the two data lines D by the data distributor 160, is supplied to each of the pixels 140. Each of the pixels 140 receiving the scan signal receives a first data signal or a second data signal. One of ordinary skill would understand that the two data lines D is a system parameter, and may consist of more than two data lines D.

Each of the pixels 140 is controlled to emit light or not emit light during the light emission period (while maintaining the supplied first data signal or second data signal during to the scan period). In other words, each of the pixels 140 receiving the first data signal during the scan period is set to a light emission state during a corresponding subframe period (e.g., during the light emission period corresponding to that subframe), and each of the pixels 140 receiving the second data signal is set to a non-light emission state during the corresponding subframe period (e.g., during the light emission period corresponding to that subframe).

The light emission period is set to have a different length in each of the subframes (SF1 to SF8) so as to express a predetermined gray scale. For example, when an image is expressed with 256 gray levels, one frame is divided into 8 subframes (SF1 to SF8), as shown in FIG. 2. Each of the 8 subframes has a successively greater light emission period, modeled by the function $2^n$ (n=0, 1, 2, 3, 4, 5, 6, 7). In other words, each of the pixels 140 displays an image with predetermined gray levels by controlling the light emission of the pixels 140 in each of the subframes in an exemplary embodiment of the present invention. The gray levels are displayed during one frame by controlling each of the pixels 140 to emit light during the subframes such that the sum of all the light emission periods displays a desired gray level. As described above, the digital drive system may display an image with uniform luminance regardless of the non-uniformity of the drive transistor in each of the pixels 140 since it displays gray levels by controlling the ON or OFF state of the pixels 140.

The frame as shown in FIG. 2 is represented by one exemplary embodiment of the present invention, but the present invention is not limited thereto. For example, the frame may be divided into 10 or more subframes, and a light emission period in each of the subframes may be set to have a different length by a designer. Each of the subframes may further include a reset period in addition to the scan period and the light emission period. The reset period may be used to set the pixels 140 to a reset state.

Figure 3:
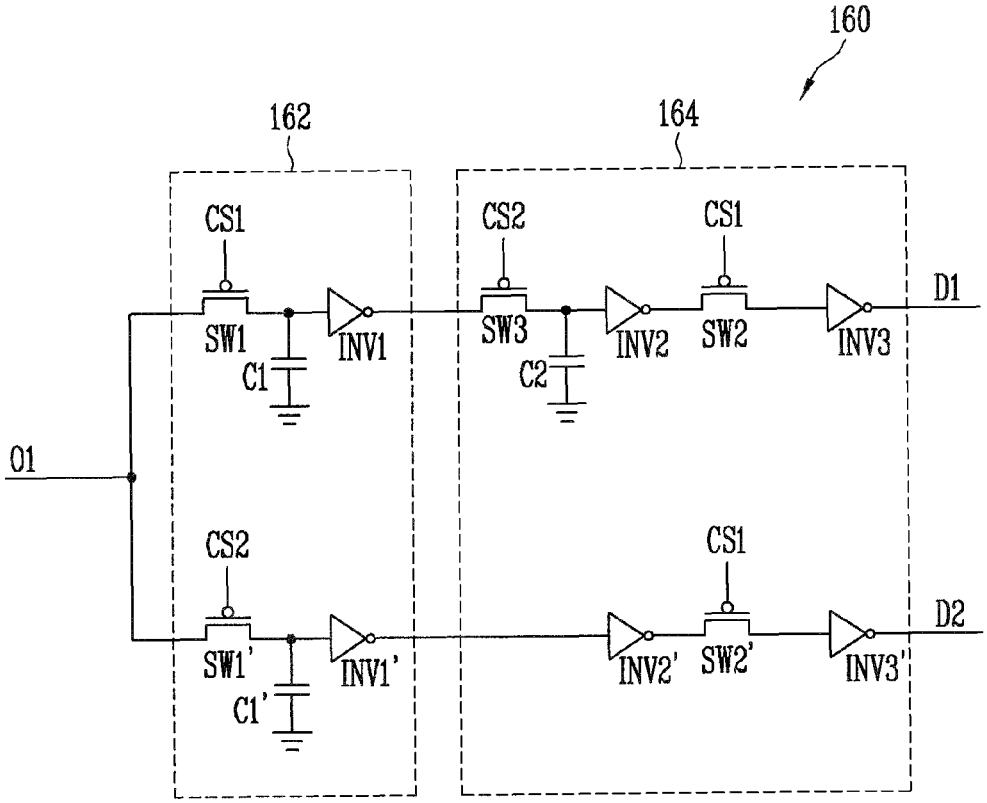
FIG. 3 is a diagram showing a data distributor unit in accordance with the organic light emitting display device of FIG. 1.

FIG. 3 is a diagram showing a data distributor in accordance with the organic light emitting display device of FIG. 1.

Referring to FIG. 3, the data distributor 160 according to one exemplary embodiment of the present invention includes a sampling latch 162 and a holding latch 164 coupled between the first and second data lines D1 and D2 and the first output line O1.

The sampling latch 162 distributes two data signals into different output channels, the two data signals being supplied from the output line O1, temporarily stores the two data signals, and transmits the two stored data signals to the holding latch 164. For this purpose, the sampling latch 162 includes first switches SW1 and SW1', first capacitors C1 and C1', first inverters INV1 and INV1', all of which are included in respective channels.

Figure 4:
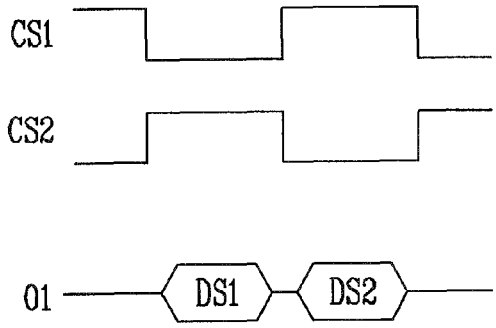
FIG. 4 is a waveform diagram showing a driving method of the data distributor unit of FIG. 3.

The first switches SW1 and SW1' included in respective channels are turned on and turned off in accordance with control signals CS1 and CS2 supplied from the timing controller 150. Here, the first switches SW1 and SW1' included in different channels are turned on during different periods so that the data signal can be distributed. For example, the first switch SW1 included in the first channel is turned on when the first control signal CS1 as shown in FIG. 4 is supplied to the first switch SW1 (that is, when the first control signal CS1 is at a LOW voltage). The first switch SW1' included in the second channel is turned on when the second control signal CS2 is supplied to the first switch SW1' (that is, when the second control signal CS2 is at a LOW voltage).

The first inverters INV1 and INV1' are coupled between the first switches SW1 and SW1', respectively, and the holding latch 164. The first inverter INV1 included in the first channel reverses a data signal supplied from the first switch SW1, and supplies the reversed data signal to the holding latch 164. Likewise, the first inverter INV1' included in the second channel reverses a data signal supplied from the first switch SW1', and supplies the reversed data signal to the holding latch 164.

As shown in FIG. 3, the first capacitor C1 is coupled between a node between the first switch SW1 and the first inverter INV1 and ground, and the first capacitor C1' is coupled between a node between the first switch SW1' and the first inverter INV1' and ground. The first capacitor C1 included in the first channel temporarily stores a data signal supplied from the first switch SW1. Likewise, the first capacitor C1' included in the second channel temporarily stores a data signal supplied from the first switch SW1'.

The holding latch 164 concurrently distributes two data signals, supplied from the sampling latch 162, to the data lines D1 and D2. For this purpose, the holding latch 164 includes second switches SW2 and SW2', second inverters INV2 and INV2', third inverters INV3 and INV3' These components are included in respective ones of the channels.

The second inverters INV2 and INV2' respectively included in the channels reverse a data signal supplied from the sampling latch 162. The second inverter INV2 reverses a data signal supplied from the first inverter INV1. The second inverter INV2' reverses a data signal supplied from the first inverter INV1'.

The second switch SW2 is coupled between the second inverter INV2 and the data line D1, and the second switch SW2' is coupled between the second inverter and the data line D2. Here, the second switches SW2 and SW2' included in the respective channels are turned on during a same period so that the data signal can be supplied to the data lines D1 and D2 concurrently. Accordingly, the second switches SW2 and SW2' are turned on when the first control signal CS1 is supplied to the second switches SW2 and SW2'.

The third inverter INV3 is coupled between the second switch SW2 and the data line D1, and the third inverter INV3' is coupled between the second switch SW2' and the data line D2. The third inverter INV3 reverses a data signal supplied from the second switch SW2, and supplies the reversed data signal to the first data line D1. The third inverter INV3' reverses a data signal supplied from the second switch SW2', and supplies the reversed data signal to the second data line D2.

A third switch SW3 and a second capacitor C2 are further included in the first channel of the holding latch 164 in this embodiment of the present invention. The third switch SW3 is turned on when a second control signal CS2 is supplied to the third switch SW3. The second capacitor C2 temporarily stores a data signal supplied when the third switch SW3 is turned on.

FIG. 4 is a waveform diagram showing control signals supplies from a timing controller. FIG. 4 shows first and second control signals that have opposite phases. The first and second control signals are supplied from the timing controller 150. The first and second control signals are supplied when the first and second control signals have a LOW voltage (a voltage having a first polarity) in this embodiment. However, in other embodiments, the first and second control signals may be supplied when the first and second control signals have a HIGH voltage (a voltage having a second polarity).

The driving operation is described in more detail in reference to FIGS. 3 and 4. First, a first control signal CS1 is supplied from the timing controller 150. When the first control signal CS1 is supplied to the first switch SW1 included in the first channel, the first switch SW1 is turned on. When the first switch SW1 is turned on, the first data signal DS1 supplied from the output line O1 is supplied to a first capacitor C1. The first capacitor C1 temporarily stores the first data signal DS1.

When a voltage of the first data signal DS1 is stored in the first capacitor C1, the first control signal CS1 is no longer supplied, and a second control signal CS2 is supplied. When the second control signal CS2 is supplied to the first switch SW1' included in a second channel, the first switch SW1' is turned on. When the first switch SW1' is turned on, the second data signal DS2 supplied to the output line O1 is supplied to a first capacitor C1'. The first capacitor C1' temporarily stores the second data signal DS2.

Further, the third switch SW3 is turned on during a period when the second control signal is supplied. When the third switch SW3 is turned on, the first data signal DS1 stored in the first capacitor C1 is supplied to the second capacitor C2, and the second capacitor C2 temporarily stores the first data signal DS1.

Afterwards, the second control signal CS2 is turned off, and the first control signal CS1 is supplied. When the first control signal CS1 is supplied to second switches SW2 and SW2' included in the respective channels, the second switches SW2 and SW2' are turned on. When the second switch SW2 included in the first channel is turned on, the first data signal DS1 stored in the second capacitor C2 is supplied to a first data line D1 via a third inverter INV3. When the second switch SW2' included in the second channel is turned on, the data signal DS2 stored in the first capacitor C1' is supplied to a second data line D2 via a third inverter INV3'. Therefore, a data signal is supplied to all of the data lines D1 to Dm concurrently when the first control signal CS1 is supplied.

The data distributor 160 according to one exemplary embodiment of the present invention supplies a data signal to the data lines D1 to Dm by repeating the above-mentioned driving operation. Each of the channels includes three inverters INV, as shown in FIG. 3. When each of the channels includes odd-numbered inverters INV as described above, the polarity of the data signal supplied from the output line O is reversed and outputted. Therefore, a previously reversed data signal is outputted into the data driver 120 to supply a data signal with desired polarity to the data lines D in accordance with an exemplary embodiment of the present invention.

The organic light emitting display device according to one embodiment of the present invention and the driving method thereof may reduce the manufacturing cost since a data signal supplied to one output line O is transmitted to two data lines D using the data distributor 160. Also, the organic light emitting display device according to an exemplary embodiment of the present invention supplies a data signal from the data distributor 160 to the data lines D concurrently, thereby supplying the data signal to each of the pixels 140 for the correct amount of time.

While the present invention has been described in connection with certain exemplary embodiments, one of ordinary skill in the art would understand that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display device, comprising:

a scan driver for supplying a scan signal to scan lines during a frame time-divided into a plurality of subframes;

a data driver coupled to output lines, and configured to supply data signals to each of the output lines;

data distributors coupled to the output lines, and configured to distribute the data signals to data lines, concurrently, in synchronization with the scan signal;

pixels located at crossing regions of the data lines and the scan lines; and a timing controller for supplying a first control signal and a second control signal to the data distributors, wherein the first control signal and the second control signal have opposite phases, wherein each of the data distributors comprises:

a sampling latch for distributing the data signals to different channels and for storing the data signals; and a holding latch coupled to the sampling latch, and configured to supply the data signals of the channels to the data lines concurrently, and wherein each of the channels in the sampling latch comprises:

a first switch coupled to one of the output lines;

a first inverter coupled between the first switch and the holding latch; and a first capacitor coupled to a node between the first switch and the first inverter.

2. The organic light emitting display device according to claim 1, wherein the first switch of each of the channels is turned on during different time periods.

3. The organic light emitting display device according to claim 1, wherein the first switch of a first channel of the channels is turned on when the first control signal having a first polarity is supplied to the first switch, and the first switch of a second channel of the channels is turned on when the second control signal having the first polarity is supplied to the first switch.

4. An organic light emitting display device, comprising:

a scan driver for supplying a scan signal to scan lines during a frame time-divided into a plurality of subframes;

a data driver coupled to output lines, and configured to supply data signals to each of the output lines;

data distributors coupled to the output lines, and configured to distribute the data signals to data lines, concurrently, in synchronization with the scan signal;

pixels located at crossing regions of the data lines and the scan lines; and a timing controller for supplying a first control signal and a second control signal to the data distributors, wherein the first control signal and the second control signal have opposite phases, wherein each of the data distributors comprises:

a sampling latch for distributing the data signals to different channels and for storing the data signals; and a holding latch coupled to the sampling latch, and configured to supply the data signals of the channels to the data lines concurrently, and wherein each of the channels in the holding latch comprises:

a second inverter coupled to the sampling latch;

a second switch coupled between the second inverter and a corresponding one of the data lines; and a third inverter coupled between the second switch and the corresponding one of the data lines.

5. The organic light emitting display device according to claim 4, wherein the second switch in each of the channels in the holding latch is turned on at the same time.

6. The organic light emitting display device according to claim 5, wherein the second switch in each of the channels in the holding latch is turned on when the first control signal having a first polarity is supplied to the second switch.

7. The organic light emitting display device according to claim 4, wherein a first channel of the channels in the holding latch further comprises:

a third switch coupled between the second inverter and the sampling latch; and a second capacitor coupled to a node between the third switch and the second inverter.

8. The organic light emitting display device according to claim 7, wherein the third switch is turned on when the second control signal having a first polarity is supplied to the third switch.

9. A driving method of an organic light emitting display device, comprising:

providing digital data signals to data distributors through output lines;

distributing the digital data signals to different channels in each of the data distributors, wherein each of the channels comprises a first switch coupled with one of the data distributors, a second switch coupled with the first switch, and a first capacitor coupled to a node between the first switch and the second switch;

storing the digital data signals in the first capacitors of the channels by turning on the first switch for each of the channels in each of the data distributors at different time periods; and turning on the second switch of each of the channels to supply the digital data signals stored in the first capacitors to corresponding data lines concurrently, wherein one of the channels in each of the data distributors further comprises a third switch coupled between the first capacitor and the second switch, and a second capacitor coupled to a node between the third switch and the second switch.

* * * * *